United States Patent [19]

Miller

[11] 4,385,449

[45] May 31, 1983

[54] METHOD AND APPARATUS FOR MEASURING TILT AND RELATIVE BEARING

[75] Inventor: Alvin B. Miller, Lewisville, Tex.

[73] Assignee: Gearhart Industries, Inc., Fort Worth, Tex.

[21] Appl. No.: 250,922

[22] Filed: Apr. 6, 1981

[51] Int. Cl.[3] ..... E21B 47/22

[52] U.S. Cl. ..... 33/304; 33/301; 33/313; 33/395

[58] Field of Search ..... 200/301, 302, 304, 312, 200/313, 398, 395, 365

[56] References Cited

U.S. PATENT DOCUMENTS

| | | | |
|---|---|---|---|
| 2,851,785 | 9/1958 | Gaudin | 33/302 |
| 2,933,820 | 4/1960 | Bobo et al. | 33/302 |
| 2,992,492 | 7/1961 | Roussin | 33/302 |
| 3,037,295 | 6/1962 | Roberson | 33/302 |
| 3,350,782 | 12/1967 | Bey | 73/1 |
| 3,520,065 | 7/1970 | Pace | 33/302 |
| 3,555,691 | 1/1971 | Jacoby et al. | 33/304 |
| 3,938,255 | 2/1976 | Lichte, Jr. | 33/311 |
| 3,975,831 | 8/1976 | Jysky et al. | 33/395 |
| 3,984,918 | 10/1976 | Chaney | 33/366 |
| 4,040,189 | 8/1977 | La Coste | 33/312 |
| 4,216,590 | 8/1980 | Kelly | 33/304 |

*Primary Examiner*—Willis Little

*Attorney, Agent, or Firm*—Head, Johnson & Stevenson

[57] ABSTRACT

An improved inclinometer and method for simultaneously measuring tilt and relative bearing in remote hostile environments such as oil and gas wells involving a pair of pendulum masses attached to perpendicularly intersecting shafts and individually capable of creating rotational motion through angles characteristic of tilt and relative bearing wherein, by use of a differential gearing system, the rotational motion induced by tilt and rotational motion induced by relative bearing are summed as a single rotational motion parallel to the axis of rotation of the relative bearing induced rotation and collinear to the well bore such that potentiometers responsive to relative bearing and the sum of tilt and relative bearing generate electrical signals that can both be transmitted to the surface without the use of troublesome slipring electrical contacts or the like. In this manner the reliability and durability of instrument is improved.

20 Claims, 7 Drawing Figures

METHOD AND APPARATUS FOR MEASURING TILT AND RELATIVE BEARING

BACKGROUND OF THE INVENTION

1. Field of the Invention

This invention relates to the remote measurement of relative bearing and tilt in hostile environments such as occurs in oil and gas wells and the like. More specifically, the invention relates to a method and apparatus for generating electrical signals characteristic of relative bearing and the sum of relative bearing and tilt in a manner such that these electrical signals can be reliably transmitted to locations external to the bearing and tilt measurement apparatus.

2. Description of the Prior Art

During the course of drilling a well, making various well log measurements and excursions in a well, or while performing workover procedures, it is customary and frequently necessary to know the actual path the well bore takes relative to the wellhead location. Technical literature suggests, records, and reports a vast variety of methods, downhole apparatus, and related equipment for estimating, predicting, and making direct as well as indirect well bore path measurements. Such suggested methods have been based on a variety of scientific principles and theories, including gravitational, sonic and seismic techniques, as well as electrical measurements, optical systems, drilling parameter monitoring schemes, and various combinations of same. One of the more reliable and most practical techniques for determining a well bore path in the earth's substrate is the use of a downhole instrument referred to as an inclinometer. An inclinometer is employed to continuously measure the bearing and tilt of a borehole as a function of the inclinometer's distance from the wellhead. By using the recorded inclinometer data, the well bore path can be mathematically computed. The tilt, as the word implies, is quantitatively the number of degrees that the well bore deviates from true vertical (i.e., an imaginary line passing through the earth's center to the well opening at the earth's surface). A zero degree tilt corresponds to a perfectly vertical wellbore path (i.e., straight down), whereas a ninety degree tilt means that the well bore is disposed parallel to the earth's surface (i.e., horizontal). The bearing is an azimuth measurement corresponding to bird's-eye view looking straight down toward the center of the earth. Bearing ranges from 0 to 360 degrees and is a relative measurement necessitating an absolute reference direction such as true or magnetic north; hence, the use of the phrase "relative bearing". Inclinometers have been used by themselves as well as in combination with a variety of other downhole tools. In practice, an inclinometer is usually positioned in a tool or carriage that aligns the inclinometer such that its axis is substantially collinear with the well bore axis. The instrument's response to its own relative bearing and tilt then directly corresponds to the well bore's bearing and tilt at any given downhole location.

The scientific principles which literature suggests as a basis for making such tilt and relative bearing measurements are almost as numerous as the principles suggested for determining well bore direction. For purposes of this invention, the subject matter deals with the response of at least one pendulum mass for determining tilt and relative bearing. Since the 1950's, inclinometers employing pendulum masses have been commercially used and represent one of the more reliable types of systems. Yet they still have limitations in terms of reliability as well as durability and long term reproducible linearity which limits commercial success and invites improvement.

SUMMARY OF THE INVENTION

In view of the criticality of inclinometer reliability due to the inordinately high cost associated with downhole instrument failure, I have discovered an improved method and apparatus for measuring both tilt and relative bearing wherein the apparatus comprises:

(a) a housing;

(b) a pendulum mass attached to a first rotatable shaft with the first shaft being connected to the housing such that movement of the mass caused by gravity results in or induces rotation of the shaft quantitatively characteristic of the relative bearing;

(c) a pendulum mass attached to a second shaft such that movement of the pendulum mass, again caused by gravity, results in or induces rotation of a rotatable member, connected or attached to the second shaft, about the longitudinal axis of the shaft quantitatively characteristic of tilt and wherein the second shaft is perpendicularly attached to the previous first shaft of subparagraph (b) such that the movement associated with subparagraph (b) also results in or induces rotation of this rotatable member, in an orbital path, about the axis of rotation of the first shaft with this orbital rotation being quantitatively characteristic of the relative bearing; and (d) a means in communication with and connected to the rotatable member that converts and sums both types of rotations of the rotatable member about the first and second shaft into rotation about the third shaft wherein this rotation of the third shaft is quantitatively characteristic of the sum of tilt and relative bearing.

The improved method associated with my invention involves and comprises the steps of: positioning the axis of rotation of rotatable first shaft of previous subparagraph (b) parallel to the direction of the well bore; creating a first electrical signal quantitatively characteristic of relative bearing by using or employing a transducer responsive to the rotation of this first shaft induced or caused by gravity; attaching the second shaft, having the structure described in previous subparagraph (c), perpendicular to the first shaft such that movement of the mass results in or induces movement of the member quantitatively characteristic of both tilt and relative bearing; creating a second electrical signal quantitatively characteristic of the sum of relative bearing and tilt by using or employing a transducer responsive to both types of rotation and/or movement of the member; and transmitting the created first and second electrical signals to the surface.

In other words, the apparatus for measuring both tilt and relative bearing comprises:

(a) a housing;

(b) at least one pendulum mass attached to the housing;

(c) a means in communication with the pendulum mass to generate an electrical signal characteristic of the relative bearing; and (d) a means in communication with the pendulum mass to generate an electric signal characteristic of the sum of relative bearing and tilt.

The instant invention further provides for the rotatable member to be a first bevel gear of a differential gear system which is in communication with the third shaft; i.e., is connected to and drives the third shaft. In this embodiment, a second bevel gear, engaged to the first bevel gear, is provided concentric to, and free to rotate about, the first (relative bearing) shaft thus inherently producing a rotational motion equivalent to the sum of tilt and relative bearing. It is further provided that a pair of spur gears be employed wherein the first drive spur gear is attached to the second bevel gear and then engaged to the second drive spur gear which is in turn attached to the third shaft. A pair of transducers are each attached to the housing and to either the first shaft or the third shaft and are responsive to the rotational motion of the shaft thus creating electrical signals characteristic of the relative bearing and the relative bearing plus tilt, respectively. The transducers can be potentiometers.

A primary object of the present invention is to provide an apparatus and method for measuring tilt and relative bearing in remote hostile environments with greater reliability and instrument durability. An additional object is to minimize the number of moving electrical contacts to be operated at bottom-hole conditions and completely eliminate previously employed electrical slipring contacts and the like. A specific object is to mechanically convert the rotational motion associated with a measurement of tilt and sum this with the rotational motion associated with a measurement of relative bearing thus producing a composite rotational motion wherein the axis of rotation is compatible with the elimination of electrical slipring contacts.

DESCRIPTION OF THE PREFERRED EMBODIMENTS

Figure 1:
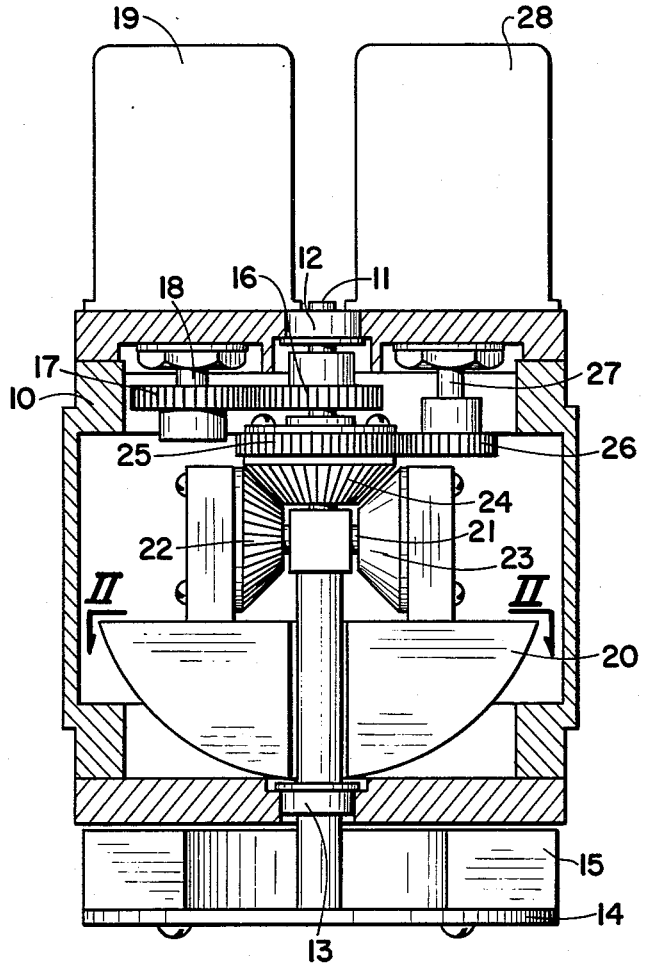
FIG. 1 is a partial cut-away view of an inclinometer according to the present invention illustrating key features and their interrelation.
Figure 3:
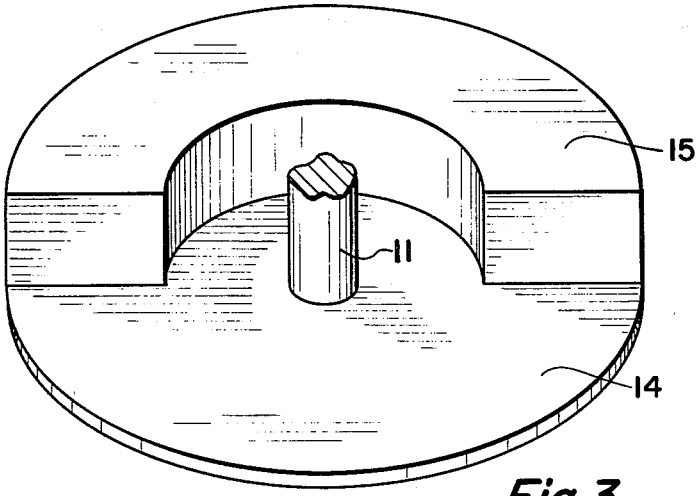
FIG. 3 is a downward cross-sectional isometric view of the relative bearing pendulum mass of FIG. 1.

The improved method and associated apparatus for measuring tilt and relative bearing according to the instant invention can perhaps be best explained and understood by reference to the accompanying drawing. FIG. 1 illustrates a partial cutaway view of a simplified preferred inclinometer. In this drawing only the inclinometer housing 10 has been cut away (see hatch marks) exposing the internal components. A so-called "relative bearing" or first shaft 11 extends through housing 10 at both ends. At the time of measuring and recording tilt and relative bearing, this shaft 11 is held, in principle, parallel and concentric in the well bore. Shaft 11 is supported and free to rotate, relative to housing 10, about its longitudinal axis by virtue of bearings 12 and 13. Attached to shaft 11 (see also FIG. 3 for perspective) at the lower end is a circular disc 14 which has a semi-circular relative bearing mass 15 attached and physically displaced, in this illustration, behind shaft 11. Attached to shaft 11, near the top of the housing, in a 1:1 gear ratio, is a drive spur gear 16 engaged to a driven spur gear 17. The driven gear 17 is attached to the central wiper shaft 18 of relative bearing potentiometer 19. Whenever the inclinometer is tipped or held off vertical (i.e., the axis of rotation through the center of shaft 11 is not vertical) the relative bearing mass 15 will seek the lowest point and in doing so will rotate the central wiper blade of potentiometer 19 to a position relative to housing 10, that is characteristic of the bearing relative to the housing. When a voltage is applied across the fixed resistive winding element of the potentiometer, the voltage appearing between the central potentiometer wiper terminal and the reference terminal will be related to and a direct measurement of the position of mass 15 relative to housing 10 (i.e., a measurement of the relative bearing).

Figure 2:
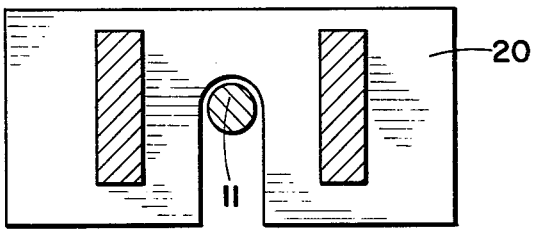
FIG. 2 is a downward cross-sectional view of the tilt mass taken along the line II—II of FIG. 1.

Tilt mass 20 is attached to a second shaft 21 which is perpendicularly connected to relative bearing shaft 11 such that the tilt mass 20 is free to move or rotate away from shaft 11 about the longitudinal axis of shaft 21 in only one direction. This can be seen more explicitly in FIG. 2 wherein the cross-section of tilt mass 21 is geometrically designed to have the center of gravity of the mass coincide with the axis of rotation, the center, of shaft 11. The unidirectional motion of tilt mass 20 is accomplished by placing the shaft 11 (at vertical inclination) in a slot with the slot being on the opposite side of shaft 11 to that of relative bearing mass 15. In this manner, whenever the inclinometer is tipped or held off vertical the relative bearing mass 15 will seek the lowest point as previously described which in turn will rotate and allow the tilt mass 20 to seek its lowest point by swinging downward about the longitudinal axis of shaft 21. In doing so the center of gravity associated with tilt mass 20 will move off the axis of rotation of shaft 11 and reinforce the relative bearing mass 15 movement. The angle through which the tilt mass rotates to seek its lowest point (i.e., the rotation about shaft 21) is quantitatively related to the tilt of the inclinometer and well bore.

Tilt mass 20 is mounted on differential bevel gear 22 and counter-mass 23 thus maintaining symmetry about shaft 11 preserving the desired center of gravity. Differential bevel gear 22 is engaged to and in mesh with bevel gear 24 which is rigidly fastened to spur gear 25. Spur gear 25 is in mesh with spur gear 26, in this case a 2:1 gear ratio, which is attached to shaft 27 that drives wiper terminal of potentiometer 28. Tilt mass 20 is free to rotate about the axis of shaft 21 and is forced to rotate with rotation of shaft 11. The range of rotation of tilt mass 20 about axis of shaft 21 is, in this case, restricted to 90° representing a change in position of shaft 11 from vertical to horizontal. This restricted range of motion is accomplished at the lower end, 0°, by the geometry of the slot in tilt mass 20 and at the upper end, 90°, by an appropriately placed stop (not shown).

Although the specific motions by the respective masses (as disclosed in the drawings) are independently quantitatively characteristic of tilt and relative bearing angles, the differential sums the two separate motions into one composite rotation. From a viewpoint stationary on the axis of shaft 11, the bevel gear 22 spins on its axis characteristic of tilt and orbits about the axis of shaft 11 characteristic of relative bearing. Each of these motions will drive the bevel gear 24 to a position characteristic of the sum of tilt and relative bearing which in turn changes the location of the wiper of potentiometer 28 correspondingly producing a voltage output related to the sum of tilt and relative bearing.

In practicing the embodiment illustrated in FIG. 1, it is preferred, but not necessary, that the potentiometer wipers of at least the tilt potentiometer 28 be exactly aligned with the gap in the circular resistive element windings when shaft 11 is exactly vertical. In this manner the electrical output voltage from the tilt potentiometer 28 is either instantaneously zero or at a maximum as the wiper contacts the beginning or the ending of the circular resistive element. Thus the gap in the resistive element will correspond to the inclinometer being vertical.

It can further be seen in the illustrated embodiment that if the vertical shaft 11 is tilted back into the plane of the drawing with the bottom remaining fixed the relative bearing mass 15 will not rotate about the axis of shaft 11 but tilt mass 20 will swing away from shaft 11 through an angle corresponding to the degree of tilt. Because of the 2:1 step-up ratio of spur gears 25 and 26 the wiper blade of potentiometer 28 will traverse an angle twice that corresponding to the degree of tilt. In other words, the 0° to 90° range of tilt mass 20 movement corresponds to a 0° to 180° rotation of potentiometer 28. Careful inspection of the drawing will confirm that the motion associated with relative bearing is similarly multiplied by a factor of two in the illustrated embodiment. Because of this, interpretation of the electrical signal from potentiometer 28 will be different from that of potentiometer 19; i.e., in this case the wiper blade observed potential will be divided by the applied potential and then divided by a factor of two before being converted to degrees of rotation (multiplication by 360°). In other words the angle of rotation associated with the wiper blade of potentiometer 20 represents the sum of tilt and relative bearing angles multiplied by two. Obviously, tilt angle can be obtained by subtracting the relative bearing, RB, expressed in degrees from one-half the potentiometer 20 output also expressed in degrees according to the following equation:

$$\text{Tilt} = [(\text{Potentiometer 20 Output})/2] - \text{RB}$$

Equivalent equations for other gear ratios can be similarly derived. Further mathematical interpretation of the respective outputs involves not only the selected gear ratios and initial reference points of the wiper blades relative to the gap in the circular resistive element but also the combination of choices of respective reference terminals of the resistive element to be used in combination with the wiper blade element voltage measurement in addition to a fundamental understanding of the periodicity and sense of rotational motion. In any event, the instant invention allows for reliable transmission of two electrical signals to the earth's surface without the use of slipring electrical connections wherein one signal is characteristic of relative bearing and the other is characteristic of tilt plus relative bearing. The relative bearing measurement in combination with a reference or absolute bearing measurement of the housing determines the actual bearing of the well bore which can then be subtracted from the tilt plus bearing measurement to calculate the actual tilt of the well bore.

This reference or absolute bearing of the inclinometer housing can be made by any method known in the art. Preferably a magnetic compass mounted on gimbals which are rigidly held in a fixed relationship to the inclinometer can be used. Since the axis of rotation of the magnetic compass will be essentially collinear to the direction of well bore and since the gimbal held compass does not rotate relative to the inclinometer, a potentiometer driven by the compass rotation can also be reliably transmitted to the earth's surface and supply the desired reference bearing measurement.

In selecting material to construct the inclinometer and in establishing tolerances between fixed and moving parts, the facts that the instrument is to be used in high temperature hostile environments and that it will experience a broad range of operating temperatures should be taken into consideration. Since a gimballed magnetic compass is usually a companion to the inclinometer the liberal use of nonmagnetic metals is appropriate; for example, aluminum for various structural components is preferred with the moving parts subject to wear preferably being stainless steel or the like. Selection of the pendulum mass material is based primarily on a desire to optimize the density. Various heavy metals can be used with certain tungsten based materials with densities approaching 18 g/cc being preferred particularly in that they can be powder molded into advantageous shapes.

Figure 4:
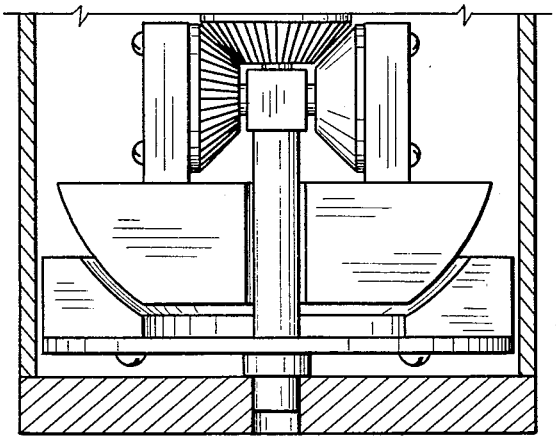
FIG. 4 is a partial cut-away view of an embodiment illustrating an inclinometer with both pendulum masses internal to the housing.

The actual shape and relative position of the elements comprising the inclinometer can vary from that disclosed in FIG. 1. However, mass symmetry about the relative bearing shaft should be preserved. For example, see FIG. 4, the relative bearing mass can easily be placed within the housing and the respective tilt and relative bearing masses can be shaped to minimize the overall dimensions making a very compact inclinometer.

Figure 5:
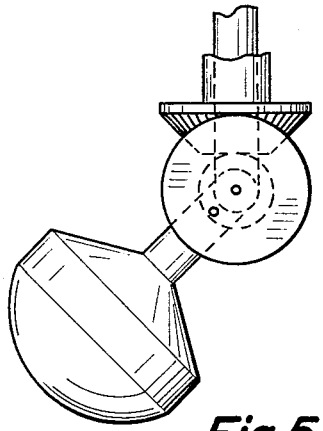
FIG. 5 illustrates a single pendulum mass system with concentric shafts.
Figure 6:
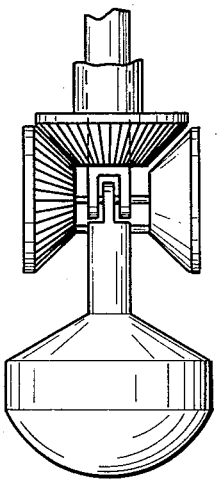
FIG. 6 is a side view of the single mass system of FIG. 5.

As a further reduction in size toward a smaller and more compact inclinometer, the pair of potentiometers can be replaced by a single stacked potentiometer driven by concentric shafts, see FIGS. 5 and 6, extending to two different vertically positioned wiper blades within the potentiometer. Such a potentiometer can be placed coaxial with the relative bearing shaft thus eliminating any internal spur gears.

Figure 7:
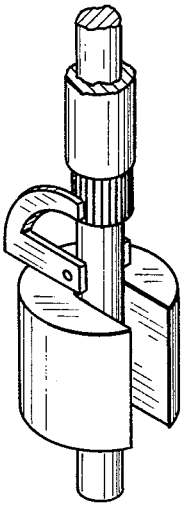
FIG. 7 is another single pendulum mass system with simplified differential gearing.

The pair of pendulum masses can be replaced by a single mass as illustrated in FIGS. 5, 6 and 7. However, in each case one of two additional complications arise. As illustrated in the embodiment of FIGS. 5 and 6, if the pendulum mass is free to swing either left or right an uncertainty is introduced as to which direction the mass has actually tilted. This can be overcome by an appropriately positioned stop, tether or the like. As illustrated in FIG. 7, if the single pendulum means is not free to swing but is constrained by a slot around a fixed shaft, there will exist a relative bearing at which tilt induced movement will be prevented by the presence of the shaft. This can be overcome by jiggling the inclinometer which will usually occur naturally or it can be effected by the motorized locking mechanisms that are commonly used and frequently accompany such as instrument downhole.

The particular choice of potentiometers to be used in the instant invention can be any of such devices known to the art that can withstand and operate at downhole conditions. For purposes of this invention any transducer responsive to rotation of a shaft and compatible with downhole conditions is considered equivalent to the preferred potentiometer including, but not limited to such devices as resolvers, optical encoders, variable differential transformers, accelerometers, strain gauges and the like. Similarly any orthogonal mechanical torque converter operable at downhole conditions should be considered equivalent to the preferred bevel gear differential including but not limited to belt or chain driven differentials, a torque transmission cable, a planetary ring gear system and the like.

When utilizing the device of the instant invention in well logging applications it is customary to mount the inclinometer and associated compass in a single case or enclosure such that a single unit can be mounted on or in the alignment tool or holder to be lowered into the well. Such case or enclosure can be provided with appropriate locks and supports to hold the inclinometer elements immobile until actual measurements of tilt and relative bearing at appropriate depths are to be performed. The present invention is compatible with such safeguards.

In using the present invention certain specific advantages will be realized. Since the motion associated with tilt is mechanically transformed into a rotational motion not requiring electrical sliprings (i.e., the tilt potentiometer is rigidly fixed to the housing), the frequency of downhold failure particularly at high temperatures is reduced while reliability and durability of the instrument is preserved. As an additional advantage, the wiper blade element of the tilt potentiometer will in the preferred embodiment experience a uniform wear distributed about the entire 360° rotation which eliminates nonlinearity previously associated with potentiometers mounted on the tilt mass shaft.

Having thus described the preferred embodiments, it should be apparent that the basic invention can be employed with other various embodiments in environments other than oil and gas wells without departing from the intended breadth of the invention and such acts are contemplated to be within the scope of the following claims.

I claim:

1. An apparatus for measuring both tilt and relative bearing comprising:

(a) a housing;

(b) a mass attached to a first shaft with said first shaft being connected to said housing such that movement of said mass results in rotation of said first shaft characteristic of the relative bearing;

(c) a mass attached to a second shaft, wherein said second shaft is operatively attached to a rotatable member, such that movement of said mass results in rotation of said member about the longitudinal axis of said second shaft characteristic of tilt and said second shaft being perpendicularly attached to said first shaft such that said movement associated with (b) also results in rotation of said rotating member about said first shaft characteristic of the relative bearing; and (d) a means in communication with said rotating member that converts and sums both said rotations of said member about said first and second shafts into rotation about a third shaft characteristic of the sum of tilt and relative bearing.

2. An apparatus of claim 1 wherein said member rotating about the longitudinal axis of said second shaft is a first bevel gear and said means in communication with said member includes a second bevel gear, engaged to said first bevel gear, concentric to and free to rotate about said first shaft and said second bevel gear is in communication with said third shaft.

3. An apparatus of claim 2 wherein said communication involves a drive gear attached to said second bevel gear and engaged to a driven gear attached to said third shaft.

4. An apparatus of claim 1, 2, or 3 further comprising:

(a) a first transducer attached both to said first shaft and housing thus outputting a signal characteristic of the relative bearing; and (b) a second transducer attached both to said third shaft and housing thus outputting a signal characteristic of the sum of tilt and relative bearing.

5. An apparatus of claim 4 wherein said transducers are potentiometers.

6. An inclinometer for measuring both tilt and relative bearing in a well bore comprising:

(a) a housing;

(b) a relative bearing pendulum mass attached to a relative bearing shaft collinear with the well bore and mounted in said housing such that movement of said relative bearing pendulum mass results in rotation of said shaft characteristic of relative bearing;

(c) a tilt mass attached to a second shaft such that movement of said tilt mass results in rotation of a rotatable member about the longitudinal axis of said second shaft with said rotation being characteristic of the tilt and said second shaft being perpendicularly attached to said first shaft such that said movement of said relative bearing pendulum mass also results in rotation of said tilt mass, second shaft and rotatable member about said first shaft characteristic of the relative bearing;

(d) a means, in communication with said rotatable member, for converting and summing said rotations of said rotatable member about the axis of said first and second shaft into a rotation about a third shaft characteristic of the sum of the tilt and relative bearing;

(e) a first transducer attached both to said first shaft and housing thus outputting a signal characteristic of the relative bearing; and (f) a second transducer attached both to said third shaft and housing thus outputting a signal characteristic of the sum of tilt and relative bearing.

7. An inclinometer of claim 6 wherein said rotatable member is a first bevel gear and said means, in communication with said rotatable member includes a second bevel gear, engaged to said first bevel gear, concentric with and free to rotate about said first shaft and said second bevel gear is in communication with said third shaft.

8. An inclinometer of claim 6 wherein said communication involves a drive gear attached to said second bevel gear and engaged to a driven gear attached to said third shaft.

9. An inclinometer of claim 6, 7, or 8 wherein said transducers are potentiometers.

10. A method for measuring both tilt and relative bearing in a well bore comprising the steps:

(a) positioning the axis of rotation of a first shaft having a mass attached such that movement of said mass results in rotation of said first shaft characteristic of relative bearing;

(b) creating a first electrical signal characteristic of relative bearing by use of a transducer responsive to rotation of said first shaft;

(c) attaching a second shaft perpendicular to said first shaft, said second shaft having a mass attached such that movement of said mass results in rotation of a member about the longitudinal axis of said second shaft characteristic of tilt and movement associated with step (a) results in movement of said member characteristic of relative bearing;

(d) creating a second electrical signal characteristic of the sum of relative bearing and tilt by use of a transducer responsive to both rotation and movement of said member; and (e) transmitting said first and second electrical signals to the surface.

11. A method of claim 10 wherein said member is a first bevel gear displaced about the longitudinal axis of said second shaft and engaged to a second bevel gear, said second bevel gear being concentric with and free to rotate about said first shaft such that said rotation is characteristic of the sum of relative bearing and tilt.

12. A method of claim 10 or 11 wherein said transducers are potentiometers.

13. A method of claim 12 wherein said second bevel gear is attached to a drive gear engaged to a driven gear mounted on a third shaft which transmits rotational motion to one of said potentiometers characteristic of the sum of relative bearing and tilt.

14. An apparatus for measuring both tilt and relative bearing comprising:

(a) a housing;

(b) at least one pendulum mass attached to said housing;

(c) a means in communication with said pendulum mass to generate an electrical signal characteristic of the relative bearing; and (d) a means in communication with the pendulum mass and responsive to the relative motion of said pendulum mass such as to generate an electrical signal characteristic of the sum of relative bearing and tilt.

15. An apparatus of claim 14 wherein said means in communication with said pendulum mass to generate an electrical signal characteristic of the relative bearing includes: a first shaft pivotally attached to said pendulum mass and pivotally connected to said housing such that movement of said pendulum mass caused by the force of gravity results in a rotation of said first shaft to a positon characteristic of relative bearing; and a transducer attached to said housing wherein said transducer is responsive to said position of said first shaft thus generating said electrical signal characteristic of relative bearing.

16. An apparatus of claim 15 wherein said means in communication with said pendulum mass to generate an electrical signal characteristic of the sum of relative bearing and tilt includes: a first bevel gear driven by and rigidly attached to said pendulum mass and free to rotate about an axis of rotation perpendicular to the axis of rotation of said first shaft at the pivotal point attaching said second shaft with said pendulum mass; a second bevel gear, engaged to and driven by said first bevel gear, concentric to and free to rotate about said first shaft; a second shaft in communication with said second bevel gear and pivotally connected to said housing, such that movement of said pendulum mass caused by the force of gravity results in a rotation of said second shaft to a position characteristic of the sum of relative bearing and tilt; and a transducer attached to said housing wherein said transducer is responsive to said position of said second shaft thus generating said electrical signal characteristic of the sum of relative bearing and tilt.

17. An apparatus of claim 16 wherein said transducers are potentiometers.

18. An apparatus of claim 17 wherein said potentiometers are each driven by a set of spur gears.

19. An apparatus of claim 16 wherein said first and second shafts are concentric shafts and transducers are a single vertically stacked dual potentiometer wherein the vertically displaced wiper blades are separately driven by said concentric shafts.

20. An apparatus of claim 15, 16, 17, 18 or 19 further comprising a second pendulum mass rigidly attached to said first shaft such as to be responsive to relative bearing in concert with said first pendulum mass.

* * * * *